US011802691B2

(12) United States Patent
Pupp et al.

(10) Patent No.: US 11,802,691 B2
(45) Date of Patent: Oct. 31, 2023

(54) METHOD FOR HOLDING TOGETHER ADJACENT INCINERATOR GRATE BARS AND APPARATUS

(71) Applicant: MARTIN GmbH fur Umwelt- und Energietechnik, Munich (DE)

(72) Inventors: Helmut Pupp, Erding (DE); Ulrich Martin, Munich (DE); Axel Hanenkamp, Eichenau (DE)

(73) Assignee: MARTIN GmbH fur Umwelt- und Energietechnik, Munich (DE)

( * ) Notice: Subject to any disclaimer, the term of this patent is extended or adjusted under 35 U.S.C. 154(b) by 212 days.

(21) Appl. No.: 17/494,081

(22) Filed: Oct. 5, 2021

(65) Prior Publication Data

US 2022/0113025 A1 Apr. 14, 2022

(30) Foreign Application Priority Data

Oct. 8, 2020 (DE) ..... 10 2020 006 197.4
Nov. 5, 2020 (DE) ..... 10 2020 006 801.4

(51) Int. Cl.
*F23G 5/00* (2006.01)
*F23H 17/08* (2006.01)

(52) U.S. Cl.
CPC ..... *F23G 5/002* (2013.01); *F23H 17/08* (2013.01)

(58) Field of Classification Search
CPC ..... F23H 17/08; F23H 2900/17002; F23H 17/00; F23H 7/08
See application file for complete search history.

(56) References Cited

U.S. PATENT DOCUMENTS 503,169 A * 8/1893 Shearer ..... F23H 17/12 126/167
4,471,704 A * 9/1984 John ..... F23H 17/12 110/109
4,548,139 A * 10/1985 Weber ..... F23H 17/08 110/328
4,776,287 A * 10/1988 Moreau ..... F23H 17/00 110/328

(Continued)

FOREIGN PATENT DOCUMENTS

DE 30 49 086 A1 12/1980
DE 198 60 552 A1 12/1998

(Continued)

*Primary Examiner* — David J Laux
(74) *Attorney, Agent, or Firm* — Ralph E. Jocke; WALKER & JOCKE

(57) ABSTRACT

A method includes producing an arrangement of grate bars for supporting fuel that is burned in an incinerator or other furnace device. The method includes positioning a pair of grate bars in adjacent side by side relation and with the respective upper sides that are configured to support the fuel, in generally aligned relation. The method further includes after positioning the grate bars, manipulating a fastener through respective recesses that extend in the grate bars, so that the grate bars are held in operative connection and in pressed together relation by the fastener. The method further includes subsequent to the fastener manipulation step, covering the recesses with at least one cover, such that the fastener is rendered inaccessible through the upper sides of the grate bars.

20 Claims, 4 Drawing Sheets

(56) References Cited

U.S. PATENT DOCUMENTS

| | | | | |
|---|---|---|---|---|
| 5,538,128 | A * | 7/1996 | Stierll | F23H 17/00 198/773 |
| 2006/0037601 | A1* | 2/2006 | von Wedel | F27D 15/0213 126/152 R |
| 2021/0364164 | A1* | 11/2021 | Martin | F23H 7/08 |

FOREIGN PATENT DOCUMENTS

| | | | |
|---|---|---|---|
| DE | 10 2017 100 408 | A1 | 12/2018 |
| EP | 3048369 | A1 | 7/2016 |
| EP | 3348904 | A1 | 7/2018 |
| FR | 2622278 | A1 | 4/1989 |

* cited by examiner

METHOD FOR HOLDING TOGETHER ADJACENT INCINERATOR GRATE BARS AND APPARATUS

TECHNICAL FIELD

Exemplary arrangements relate to a method for holding together adjacent grate bars in an incinerator or similar furnace device. Exemplary arrangements further relate to an apparatus including grate bars that are held together and reliably fixed in operative connection.

BACKGROUND

Grate bars which are sometimes alternatively referred to as grate steps, grate elements, grate plates or grate modules, are used in incinerators such as refuse incinerators to form a grate cover which supports combustible fuel material that is burned in the incinerator. The grate cover which is comprised of the adjacent grate bars, includes a fuel supporting side which includes a surface that may include openings therethrough. The openings serve to supply the air through the fuel supporting surfaces of the grate bars that is necessary for combustion ("primary air"). In some exemplary arrangements devices that are operative to cause relative movement of the grate bars provide movement and circulation of the fuel ("stoking"). In some exemplary arrangements the devices that are operative to cause relative movement of the grate bars operate automatically to facilitate the combustion of the fuel that is supported on the grate bars.

Exemplary arrangements of incinerators including grate bars are shown in U.S. Pat. Nos. 9,845,951; 6,938,563; 10,753,604; 8,939,094; 7,975,628; 5,950,548; 5,899,150; and 6,378,447, the disclosure of each of which is incorporated herein by reference in its entirety.

Exemplary arrangements relate to an inclined/moving grate. Such an arrangement of grate bars may be similar to a generally flat stairway similar to that shown in the incorporated disclosures with the slope generally between 0° and 30°, and such as for example between 24° and 26°. Such an incline between a 0° to 30° slope is referred to herein as horizontal but a grate with more than 0° slope may be referred to herein as an inclined grate. The combustible fuel is moved over the grate comprised of the grate bars. The fuel in exemplary arrangements is moved by grate steps which are comprised of the grate bars, relatively moving and transporting the fuel in operative supported connection with the grate bars. Depending on the direction of grate bar movement, the grate that is comprised of the grate bars may also be referred to as a pusher grate or a reciprocating grate. In each case the combustible fuel is moved in a forward direction within the incinerator in supported relation with the upper fuel supporting sides of the grate bars of which the grate is comprised.

Inclined grates comprised of grate bars are used for coarse and high-ash fuels that require robust stoking, such as household and commercial waste, biomass, waste wood, processed waste and/or lignite (which is rarer currently).

Grates, particularly inclined grates may be comprised of a plurality of grate bars. Such grate bars are often required to be firmly connected together and/or are movable relative to one another in order to move the combustible material on the upper, fuel supporting side of the grates.

Such incinerator grates comprised of grate bars generally include openings to enable supplied air to flow through the grate bars to facilitate combustion of the fuel. To provide such air flow, opening recesses may be provided in the sidewalls of the grate bars and/or openings may be provided on the upper sides and/or the front sides of the grate bars. Such openings enable air that is conveyed to an area on a lower side of the grate bars, to pass between the grate bars or through the grate bars to the bed of combustible fuel that is supported on the grate bars.

The high temperatures and forces moving the grate bars in order to stoke and transport combustible material may result in relatively large forces being generated. Such large forces may adversely affect the fasteners holding the grate bars in connected relation and may change the relative positions of the grate bars. For example in some cases such unwanted relative movement of the grate bars may result in a grate bar being moved sideways away from the immediately adjacent grate bar resulting in undesirable slits between the adjacent grate bars or such adjacent grate bars becoming wholly or partially disconnected.

Grate bars used in grates for supporting fuel combusted in incinerators and similar furnace environments may benefit from improvements.

SUMMARY OF DISCLOSURE

Exemplary arrangements described herein provide improved fuel supporting grates configured for use in incinerators and similar furnace environments, and methods of making such grates, that are comprised of a plurality of grate bars. In exemplary arrangements the grate bars are arranged in parallel side by side relation to form a grate, or in some arrangements a grate step which is used in conjunction with a plurality of other grate steps.

In some exemplary arrangements grate bars are arranged to be held together parallel and adjacent to one another in pressed together relation during operation. The grate bars are held together with fasteners which in some arrangements may include clamps, threaded fasteners, pins, screws or other fastener types which are suitable for holding adjacent grate bars in pressed together relation.

In some exemplary arrangements the grate bars are connected so as to be selectively detachable from other grate bars. In exemplary arrangements this enables grate bars that have been damaged during operation to be replaced without having to replace the entire grate or grate step. This is accomplished in some exemplary arrangements by positioning the fasteners which hold grate bars together away from the upper side of the grate bars which supports the fuel thereon. Such positioning away from the fuel supporting surfaces of the upper sides of the grate bars helps to reduce the harmful effects of temperature and corrosion on the fasteners.

Further exemplary arrangements facilitate the ability to access the fasteners that hold the grate bars in pressed together relation. Further the exemplary arrangement reduces the risk that the fastener may fall out from engaged relation with each of the adjacent grate bars when it is not desired, such as during placement of the fastener in engagement with the grate bars, during manipulation to tighten the fastener and/or during operation of the incinerator.

In exemplary arrangements a method of making the incinerator grate includes positioning a pair of grate bars in adjacent parallel horizontal side by side relation. Each grate bar includes a respective upper side configured to support the fuel burned by the incinerator thereon. The upper side of each grate bar further includes a recess that extends therein.

With the grate bars in adjacent relation the method further includes manipulating a fastener through the respective recesses of the respective adjacent grate bars. The fastener is manipulated through the recesses so that the grate bars are held in pressed together relation by the fastener. In some exemplary arrangements the recesses each extend from a respective edge that bounds the upper side that supports the fuel on the respective grate bar. The recesses are aligned so as to produce a common opening that spans between the upper sides of the adjacent grate bars. This provides greater access through the common opening to the fastener and facilitates manipulation thereof.

Further in some exemplary arrangements each respective grate bar includes a respective projection. The respective projections extend upwardly and terminate below the recesses, and extend perpendicular to the respective upper side of the grate bar of which the projection is a part. In some arrangements the respective projections are positioned in side by side relation when the grate bars are positioned in adjacent relation. In exemplary arrangements the fastener can be extended through the common opening and manipulated to engage each respective projection of the grate bars and to hold the projections and the grate bars in pressed together relation. In some arrangements the fastener may comprise a clamp that is operative to engage and hold the projections in pressed together relation. In other exemplary arrangements each of the projections includes a slot. The slots may extend through the projections in a direction parallel to the fuel supporting upper sides of the grate bars and may be linearly aligned so as to receive a threaded fastener therein when the grate bars are in adjacent relation. The threaded fastener may be extended through the common opening to engage in the slots and be tightened by manipulation of the fastener to hold the grate bars in pressed together relation. Other types of fasteners may also be used in other arrangements.

In some exemplary arrangements at least one expansion piece may be positioned in operative connection with each of the grate bars. The expansion piece may have a coefficient of thermal expansion that is different than each of the grate bars. In such arrangements the at least one expansion piece is operative to cause the grate bars to be in pressed together relation with higher force at elevated temperatures.

In further exemplary arrangements the recesses or a common opening formed thereby are covered by at least one cover. The cover is operative to render the fastener inaccessible from the upper sides through the grate bars. In exemplary arrangements the cover serves to isolate the fastener from the upper sides of the respective grate bars that during incinerator operation are in contact with the high temperature and corrosive fuel material.

In some exemplary arrangements the cover includes a cover top that extends no higher than the adjacent upper side of the grate bar. In exemplary arrangements the cover top may be positioned flush with the upper sides of the adjacent grate bars. Such a configuration may be particularly useful when the grate bar is configured to have another grate bar move on the upper side thereof including the area in which the cover is installed.

In some exemplary arrangements the cover may be secured in the at least one recess or a common opening by being anchored in the opening by a wedge. The wedge may be installed using an interference fit between a side surface of the cover and a surface bounding the recess or common opening. The force resulting from the interference fit between the wedge, the cover and the grate bars is operative to securely hold the cover and wedge in the operative positions. Further, in some arrangements it may be further desirable to weld the cover and the wedge in fixed connection with each other and/or in fixed connection with the adjacent grate bar.

Further in some arrangements while the fastener is accessible through the recesses on the upper side for purposes of manipulation such as positioning and tightening, in other arrangements access to the fastener from a lower side opposed of the upper side of the grate bars may be provided. This may provide mechanics who service the incinerator with additional options for adjustment, repair and replacement of grate bars.

Further exemplary arrangements and methods are described in greater detail herein.

DETAILED DESCRIPTION

Figure 1:
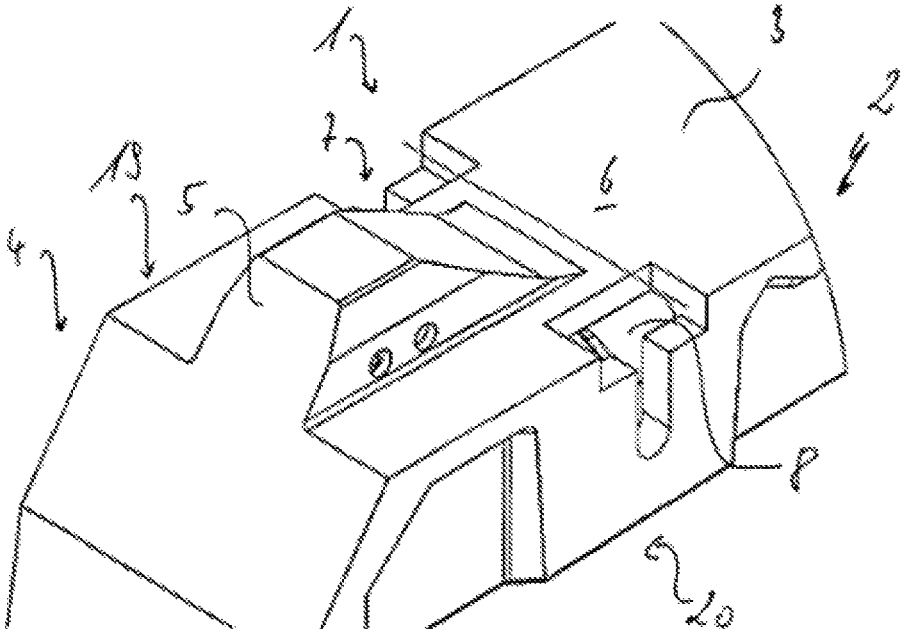
FIG. 1 is a perspective view showing a head end of an exemplary grate bar.

Referring now to the drawings and particularly to FIG. 1, there is shown therein a head 1 of a grate bar 2. It should be understood that although only the head of the grate bar is shown in the drawings, the grate bar includes other surfaces which may be similar to those described in the incorporated disclosures.

The exemplary grate bar includes an upper side 3 which is substantially flat, but which has an elevation 5 toward the front end 4. In exemplary arrangements the upper side is a fuel supporting side of the grate bar when in the operative position in an incinerator or similar furnace structure. The exemplary grate bar 2 includes recesses 7 and 8 on opposed transverse sides of the grate bar. The recesses extend in aligned relation within the upper side of the grate bar and extend inward from respective opposed edges which bound the upper side as shown. As later discussed each of the recesses are configured to receive a fastener therein, which fastener is operative to hold the grate bar in connection with an adjacent grate bar in an area below the elevation 5 and the flat region 6 on the upper side of the grate bar. It should be understood that although in FIG. 1 only a single recess is shown on each transverse side of the grate bar, in other arrangements multiple recesses may be disposed at spaced distances along the upper side of each grate bar.

Figure 3:
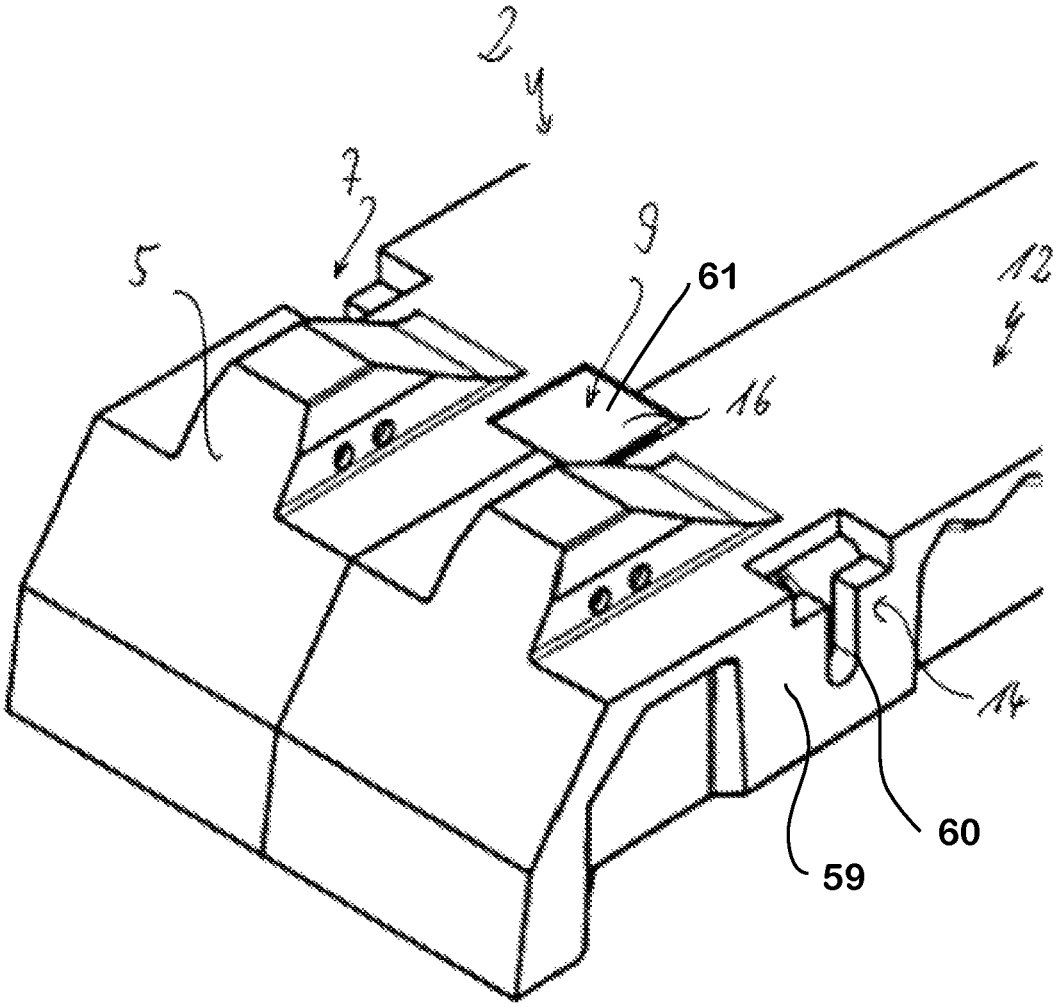
FIG. 3 is a perspective view showing the head ends of a pair of adjacent grate bars.

FIG. 3 shows a perspective view of a pair of grate bars 2 and 12 arranged in immediately adjacent side by side relation. As can be appreciated from FIG. 3, the exemplary grate bars are configured such that the recesses in the upper sides of each immediately adjacent grate bars extend inwardly in the upper surface of the respective grate bar from a horizontal edge which bounds the upper surface of the grate bar. In an exemplary arrangement the immediately adjacent grate bars are positioned such that the respective recesses are in aligned relation and bound a common opening that spans between the immediately adjacent grate bars. As can be appreciated this exemplary arrangement provides a larger common opening than is provided by a single recess. However, it should be understood that this arrangement is exemplary and in other arrangements other approaches and recess configurations may be used.

Figure 2:
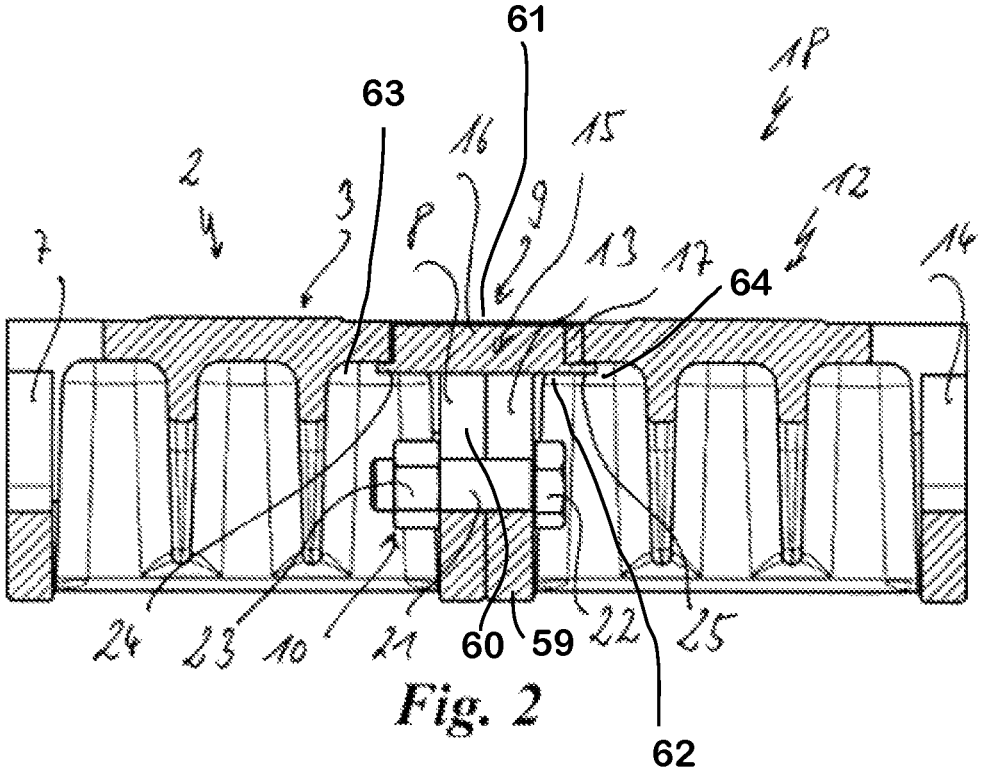
FIG. 2 is a transverse cross-sectional view of a pair of adjacent grate bars.

FIG. 2 shows a transverse cross-sectional view of the two adjacent grate bars 2 and 12 of FIG. 3. In the exemplary arrangement the adjacent grate bars are held together by a holder 9 which is in operative connection with each of the adjacent grate bars. In the exemplary arrangement shown in FIG. 2 the holder comprises a threaded fastener 10. In the exemplary arrangement the threaded fastener comprises a bolt which is alternatively referred to as a screw, which includes a bolt head 22 and a rotatable nut 23. Other types of threaded fasteners such as a threaded rod or pin may be used in this arrangement. Of course this fastener arrangement is exemplary and other fastener types may be used in other arrangements.

As can be appreciated in this exemplary arrangement the common opening which is comprised of the two immediately adjacent recesses 8 and 13, enables accessing the fastener so that the fastener can be manipulated from the top through the common opening such as by being installed in operative connection with each of the grate bars and manipulated so as to tighten the threaded fastener using wrenches or other tools that are extended through the common opening. As can be appreciated in the exemplary arrangement tightening of the fastener causes the immediately adjacent grate bars to the held in pressed together relation by the fastener.

In the exemplary arrangement shown the side surfaces of the respective grate bars below the respective recesses in transverse cross-section, include upward extending projections which may be alternatively referred to herein as side parts. The upward extending projections extend perpendicular to the upper side of the respective grate bar. The exemplary projections 59 terminate upwardly below the recess opening. In the operative position of the grate bars shown in FIGS. 2 and 3 the projections 59 are in immediately adjacent abutting side by side relation. A slot 60 extends transversely through each projection 59 in a direction parallel to the respective upper side of the grate bar. As shown in FIG. 2 in the operative position of the grate bars, the slots 60 are in aligned linear relation so that the fastener, which in this case is a bolt with a cylindrical stem, may have the stem extend therein. As shown in FIG. 2 in this exemplary arrangement the head 22 and the nut 23 of the threaded fastener extend on opposed sides of the abutting projections. As a result a threaded fastener is enabled to be placed through the common opening and within the linearly aligned slots to join the adjacent grate bars in operatively engaged relation. The threaded fastener may then be manipulated by tools such as wrenches extended through the common opening, to tighten the fastener causing the grate bars to be in pressed together relation. Of course in other arrangements other fastening approaches between the grate bars may be used.

In some exemplary arrangements the threaded fastener or other fastener that engages the grate bars in pressed together relation may serve as an expansion piece. For example in the exemplary arrangement shown the threaded fastener may have a different coefficient of thermal expansion than the grate bars. For example in exemplary arrangements the threaded fastener or other fastener type may be comprised of material that has a coefficient of thermal expansion that is smaller than the coefficient of thermal expansion of the material of the grate bars. The thermal expansion of metals and alloys is normally expressed as linear expansion which is proportional to a linear expansion coefficient indicating the length of the unit of length at a 1° increase in temperature between 0 to 100° C. The linear expansion coefficient is, for example, 1.0 for Ni steel, 30 Ni. However, for Ni steel, 20Ni, the linear expansion coefficient is as high as 19.5. This means that a threaded fastener or clamp with a lower coefficient of thermal expansion than the grate bars will expand less when heated up to 500° C., for example, in the area of the grate bars than a grate bar that is made of cast steel.

In exemplary arrangements such as those shown in FIGS. 2 and 3, by having a fastener comprised of a material that is selected to have a smaller coefficient of thermal expansion than the grate bars, the fastener can hold the immediately adjacent grate bars in pressed together relation with the relatively lower force when the incinerator is not operating and at ambient room temperatures. This enables the fastener to be manipulated so as to be loosened and removed when the incinerator is at ambient room temperatures. However, when the incinerator operates and reaches operating temperature, the increased temperature causes the fastener with the lower coefficient of thermal expansion than the grate bars, to hold the grate bars with added force and more tightly in pressed together relation. This provides a more tight and reliable connection between the immediately adjacent grate bars. Of course as can be appreciated this approach is exemplary and in other arrangements other approaches may be used. This includes certain alternative exemplary approaches that are discussed herein.

In an exemplary arrangement when in the operative position of the grate bars, the adjacent recesses 8 and 13 form a common opening, and the opening is closed by at least one cover 15. The exemplary cover is operative to render the fastener inaccessible through the recesses in the upper sides of the grate bars. The cover further serves to isolate the fastener from the upper sides of the grate bars upon which surface the fuel burned in the incinerator is supported. In the exemplary arrangement the cover is comprised of a plate portion 16. A wedge such as a tapered wedge 17 is installed with an interference fit through a pressed inward engagement between a plate portion of the cover and at least one surface bounding the recess of the common opening. In the exemplary arrangement the interference fit provided by the wedge is operative to secure the cover in closing relation with the recesses and the common opening. Of course it should be understood that this approach is exemplary and in other arrangements other approaches may be used.

While in the exemplary arrangement shown a pair of grate bars is in operative side by side fastened relation, it should be appreciated that to produce a grate cover 18 which may be a grate step comprised of the exemplary grate bars shown, a larger number of grate bars are joined together in abutting side by side relation with the upper sides of the grate bars mostly in a common plane. The number of grate bars utilized to form the cover grate depends on the configuration of the particular grate bars and the size of the grate to be utilized in the particular incinerator or furnace device. Of course it should be understood that these configurations are exemplary and in other arrangements other configurations and approaches may be used.

In some exemplary arrangements the exemplary cover 15 includes a cover top 61. In the operative position of the cover, the cover top outwardly bounds the cover and is disposed no higher outwardly than the respective adjacent upper sides of the grate bars. In an exemplary arrangement the cover top extends flush with the upper sides of the grate bars in order to minimize the risk of catching fuel materials or structures of other grate bars that may move on the upper side of the grate bars across the cover top. Of course this approach is exemplary and in other arrangements other approaches may be used.

The exemplary cover further includes an inner side 62. In the exemplary arrangement in the installed position of the cover 15, the inner side 62 is in operative engagement with the tops of the abutting projections 59 of the respective grate bars. Of course in some arrangements where the projections are held in engaged relation by a clamp that spans the tops of the projections, the inner side may be in operative engagement with the tops of the projections through the clamp.

The exemplary cover further includes a cover projection 24 which may be alternatively referred to as an undercut. The cover projection 24 is in operative connection with and in the exemplary arrangement is an extension on the inner side 62 of the cover. In the operative position of the cover, the cover projection 24 extends in engaged relation in a cover projection engaging recess 63. The exemplary cover projection engaging recess 63 extends in the interior area of the grate bar 2 and is disposed below the upper side 3. The exemplary cover further includes a similar further cover projection 25 that is disposed on an opposed side of the cover from the cover projection 24. The further cover projection 25 is in operative connection with the inner side of the cover, and in the operative position of the cover is engaged in a further cover projection engaging recess 64. As shown in FIG. 2 the exemplary cover projection 25 is of a greater length than the cover projection 24. This configuration of the exemplary arrangement enables the wedge 17 to be inserted in pressed interference engagement between a vertically extending side of the cover above the cover projection 25 and a surface bounding the common opening and the recess 13 in grate bar 12.

As can be appreciated this exemplary arrangement enables the cover to be inserted through the common opening that is comprised of the adjacent recesses 8 and 13 which make up the common opening, and to be positioned such that the cover projection 24 is engaged in the projection engaging recess 63 and the cover projection 25 is engaged in the projection engaging recess 64. Further the inner side 62 of the cover is operatively supported on top of the vertically extending projections 59. As a result the cover is held in closing relation with the common opening so that the wedge 17 can be press fit into the space between the side of the cover and the side surface of the grate bar 12 bounding the recess 13.

In some arrangements the force provided by the interference fit of the wedge is sufficient to hold the cover in the operative position and to prevent it from falling out during incinerator operation. This might be done in some arrangements by having the cover and/or the wedge comprised of material having a higher coefficient of thermal expansion than the grate bars. In some exemplary arrangements this may make it relatively easier to remove the wedge for repair purposes. In such cases with the wedge removed the cover 15 may then be moved to disengage the cover projections from the projection engaging recesses so that the cover may be removed from the common opening. This facilitates accessing and manipulating the underlying fastener for purposes of repair or replacement activities.

Further it should be understood that in some exemplary arrangements after the wedge 17 has been installed, the wedge and cover may be welded together. In such exemplary arrangements where the materials of the wedge and the cover are comprised of the material that may be welded together such as steel, the welding together of the wedge and the cover secures the cover in closing relation with the common opening. This approach may be used in situations where the grate bars are comprised of a cast material or other material to which the cover and/or wedge cannot be securely welded. However, in other exemplary arrangements the cover and/or wedge may be welded in fixed engagement with one or both of the grate bars to hold the cover and the wedge in fixed engagement with the grate bars. Of course it should be understood that these arrangements are exemplary and that in other arrangements other approaches may be used.

Figure 4:
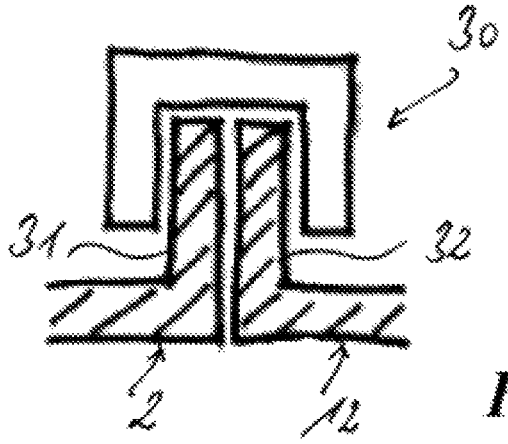
FIG. 4 is a transverse cross-sectional view showing portions of a pair of adjacent grate bars held in pressed together relation by a U-shaped clamp.

An alternative exemplary arrangement for holding the adjacent grate bars 2 and 12 in pressed together relation is shown in FIG. 4. In this exemplary arrangement a U-shaped clamp 30 extends in spanning relation over the immediately adjacent vertically extending projections 31 and 32 of the adjacent grate bars. In this exemplary arrangement the clamp 30 is manipulated through the common opening formed by the recesses above, and is pressed downward to hold the projections in side by side relation. For example in some exemplary arrangements the clamp 30 may be of an appropriate material so that the clamp is configured with an outer surface thereof closing the opening and being flush with the adjacent upper sides of the grate bars. Alternatively the clamp 30 may be configured to be down within the common opening and have a cover overlying the clamp in cases where it is desired to isolate the clamp from the corrosive elements of the combustion on the grate bar upper surfaces.

In exemplary arrangements the clamp 30 may serve as an expansion piece by being comprised of a material with a smaller coefficient of thermal expansion than the adjacent grate bars. For example the grate bars may be comprised of cast steel material. The clamp may be manipulated through the common opening by placement and engagement over the adjacent projections 31 and 32. In the exemplary arrangement where the clamp has the lower coefficient of thermal expansion, when the incinerator is at a high temperature the clamp expands to a lesser extent than the grate bars. As a result the exemplary U-shaped clamp is operative to hold the grate bars more tightly in pressed together relation during incinerator operation than when the incinerator is cool and the grate bars are at ambient room temperature.

Figure 5:
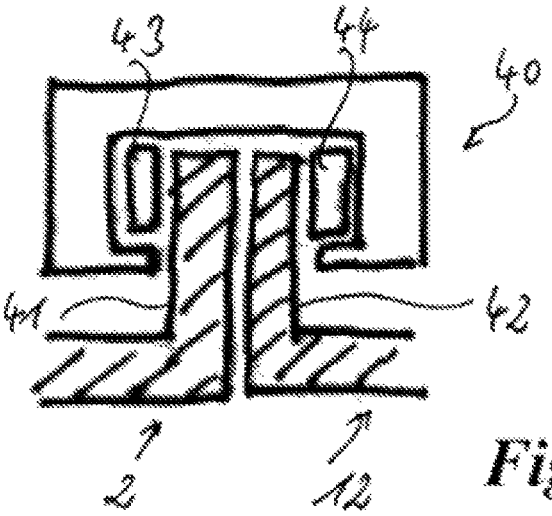
FIG. 5 is a transverse cross-sectional view showing portions of a pair of adjacent grate bars held in pressed together relation by a C-shaped clamp.

FIG. 5 shows an alternative exemplary arrangement which includes features similar to FIG. 4. In this exemplary arrangement the projections that are arranged in side by side relation are designated 41 and 42. A C-shaped clamp 40 serves as a expansion piece that is in operative engagement with each of the projections. In the exemplary arrangement the C-shaped clamp 40 may be comprised of a cast steel material, which may have a greater coefficient of thermal expansion than the adjacent grate bars 2 and 12. However in this exemplary arrangement a pair of insert plates 43 and 44 serve as further expansion pieces. Such further expansion pieces have a relatively high coefficient of thermal expansion which is greater than the coefficient of thermal expansion of the C-shaped clamp as well as the grate bars. In this exemplary arrangement the insert plates 43 and 44 cause the grate bars through the projections thereof to be pressed together horizontally as shown in the operative position, more tightly with increased temperature. In this exemplary arrangement the expansion pieces comprised of the insert plates 43 and 44 are operative to compensate for the relatively greater coefficient of thermal expansion of the clamp 40 which also serves as an expansion piece.

Figure 6:
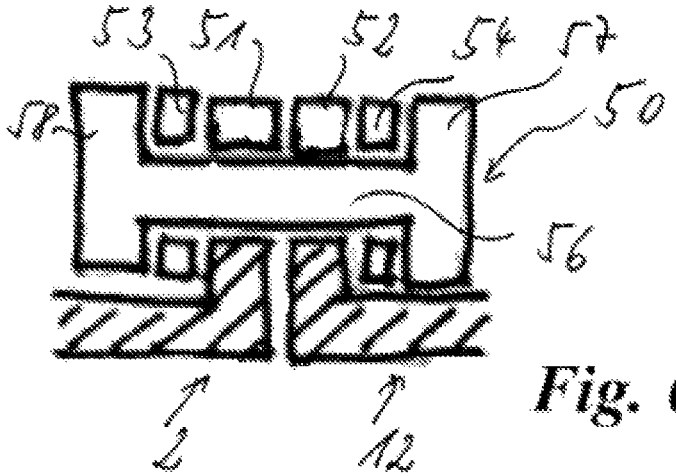
FIG. 6 is a transverse cross-sectional view showing portions of a pair of adjacent grate bars held in pressed together relation by a pin or a threaded fastener.

FIG. 6 shows an exemplary arrangement which includes the use of a fastener which comprises a pin 50. In this exemplary arrangement the pin 50 is inserted between the pair of grate bars and is in operatively engaged relation with each of the grate bars 2 and 12. In this exemplary arrangement the pin 50 may serve as an expansion piece by having a coefficient of thermal expansion that is different than the grate bars. For example in the exemplary arrangement discussed in connection with FIG. 2, the pin 50 may have a smaller coefficient of thermal expansion than the grate bars so as to hold the grate bars together more tightly with increased temperature.

However in this exemplary arrangement shown in FIG. 6, further expansion pieces in the form of washers 53 and 54 are arranged in operatively intermediate relation between the enlarged heads 57, 58 at the opposed ends of the pin 50, and the projections labeled 51, 52 of the immediately adjacent grate bars. The coefficients of thermal expansion of the expansion pieces comprised of the pin and the washers are selected in the exemplary arrangement so that the combined effect is to provide a suitable increase in the force which horizontally and laterally presses the grate bars together with increased temperature. This helps to assure that the adjacent grate bars do not separate or become relatively movable at elevated temperatures which may lead to problems or failures of the fastener or grate structures.

In some exemplary arrangements the enlarged heads 57, 58 of the pin 50 may be comprised of nuts engaged with a threaded rod 56 or other components of a threaded fastener. In such exemplary arrangements the coefficient of thermal expansion may be selected for each of the components so that the grate bars are held in pressed together relation even in the event of large fluctuations in temperatures. Of course it should be understood that these approaches are exemplary and in other arrangements other approaches may be used.

As can be appreciated the exemplary arrangements shown herein may provide benefits by holding together adjacent grate bars through fasteners that are operative to hold the grate bars together in operatively engaged side by side relation. In the exemplary arrangements the fasteners utilized to hold the grate bars in engaged relation may be manipulated through the respective recesses of the grate bars. Such manipulation may include tightening the fastener through the openings provided by the recesses. Further the ability to install a fastener from the top through recesses in the upper sides of the grate bars may avoid the need for the mechanics performing such work to access the undersides of the grate bars which may be obstructed by various types of equipment and mechanisms.

Further in the exemplary arrangement the exemplary recesses provide access for manipulation of the underlying fastener. This may be done by having recesses which provide a common opening that is sufficiently large to enable wrenches or other suitable tools to manipulate the fastener so as to tighten or loosen or release the fastener as necessary to suitably engage and disengage the adjacent grate bars. The exemplary cover arrangement further serves to isolate the underlying fastener from the heat and corrosive materials which may be present in the incinerator or other furnace environment at the upper side of the grate bars which support the fuel that is burned in the incinerator.

Further in exemplary arrangements the cover is provided with a secure connection with the grate bars and is configured to resist separation from the grate bars and displacement from the recesses during operating conditions. However in the exemplary arrangement the cover can be removed by either cutting the cover or the wedge with a cutting torch, saw or chisel and prying it out so as to be relatively readily removed when desired. This facilitates repair or replacement of the grate bars. These and other useful aspects may be provided by the exemplary arrangements.

Further in the exemplary method of producing the exemplary arrangement of grate bars a series of steps may be carried out. For example in the exemplary arrangement the grate bars are positioned in adjacent relation, such that the grate bars are positioned horizontally in supported relation with a carriage or other suitable grate supporting structure. In this exemplary positioning step the upper sides of the grate bars that are configured to support the fuel in the incinerator are positioned in adjacent side by side relation with the edges that bound the upper sides of the grate bars in an immediately adjacent relationship.

In the exemplary method because the recesses extend in the respective upper sides of the grate bars inwardly from the respective bounding edges, in the positioning step the grate bars are positioned such that the respective recesses are in aligned relation and bound a common opening. Further in the exemplary method a fastener may be manipulated through the common opening. Such manipulation may include operatively engaging the fastener with each of the grate bars and/or tightening the fastener. This may be done in the manner like that discussed in the previously described arrangements such as by extending a central stem of a threaded fastener in the linearly aligned slots that extend in the vertically extending projections of each of the respective grate bars, and then tightening the threaded fastener. Further in other exemplary arrangements the step of manipulation may include engaging a clamp with a pair of immediately adjacent projections of the respective grate bars and moving the clamp to hold the grate bars in operatively engaged relation. Of course it should be understood that other types of manipulation may be carried out through the respective recesses to engage and secure the particular fastener in operatively engaged relation with each of the grate bars.

In a further exemplary step of the method of producing the grate bar arrangement, the fastener is manipulated through the respective recesses so that the grate bars are held in pressed together relation by the fastener. In some exemplary arrangements this may include tightening of a threaded fastener via engagement of the fastener through the recesses and/or common opening with wrenches or other suitable tools to tighten the fastener as previously discussed. Further in other exemplary arrangements the manipulation step may include engaging, applying or pressing a clamp through the recesses to cause projections or other structures of the immediately adjacent grate bars to be held in pressed together relation. Further in other exemplary methods other types of fasteners may be manipulated through the respective recesses in the grate bars to cause the grate bars to be engaged in operatively attached relation and to be fastened in pressed together connection.

In exemplary arrangements the method may further include the step of installing at least one expansion piece in operative connection with the grate bars. In the exemplary method the at least one expansion piece has a different coefficient of thermal expansion than each of the grate bars. In this exemplary arrangement the grate bars are caused to be pressed together with greater force with increased temperature.

In further exemplary arrangements after the grate bars are held in pressed together relation through manipulation of the fastener the method may further include the step of covering the recesses with at least one cover. Covering the recesses with at least one cover in the exemplary arrangement serves to separate and isolate the fastener from the upper side of the grate bars which supports the fuel in the incinerator. In the exemplary arrangement the covering step includes installing a cover that has a cover top that extends outward no higher than the adjacent upper sides of the grate bars. Further in exemplary arrangements the covering step includes installing a cover with a cover top that is flush with the upper sides of the grate bars. This minimizes the risk of fuel material collecting in a recess above the cover top and/or material moving over the upper side catching in engaged relation with the cover.

In exemplary arrangements the method may further include fixing the cover in the recesses by pressing at least one wedge operatively between the cover and at least one wall bounding a recess. In the exemplary method the wedge may be installed using a pressed in interference fit which is operative to hold the cover and the wedge in fixed engagement in the recess and/or common opening. Further the exemplary method may include welding the exemplary cover to be in fixed engagement with each of the grate bars. This may include in some arrangements, welding the at least one cover in fixed engagement with the wedge. This may be done in some arrangements in situations where the cover and the wedge can be welded together to form a solid covering filling the recess and/or common opening. This may be further done in some methods in situations where successful fixed welded connections cannot be accomplished between the material of the cover and/or wedge and the grate bars. However in other exemplary arrangements the welding of the at least one cover to be in fixed engagement with each of the grate bars may include directly welding of the cover and/or the wedge to each of the grate bars where the materials enable such welding.

In further exemplary methods the cover may include cover projections that are in operative connection with an inner side of the cover and are disposed in opposed cover sides. The method may include a cover engaging step that includes engaging a cover projection with a cover projection engaging recess in one grate bar, and engaging a further cover projection with a further cover projection engaging recess in the other immediately adjacent grate bar. Further in some exemplary methods each grate bar may include a respective projection that extends perpendicular to the upper side of the grate bar and below the recesses. The exemplary cover engaging step may further include operatively engaging the inner side of the cover with the projections. Such engagement may be further operative to hold the cover positioned in the recesses and/or common opening.

Of course it should be understood that these method steps are exemplary and in other arrangements different or additional method steps may be utilized.

Thus the exemplary arrangements achieve improved operation, eliminate difficulties encountered in the use of prior devices and methods, and attain useful results described herein.

In the foregoing description certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the exact features shown and described. Further it should be understood that the features and/or relationships associated with one arrangement can be combined with the features and/or relationships from another arrangement described herein. That is, various features and/or relationships from the various arrangements can be combined to produce further arrangements, and the new and useful scope of the disclosure herein is not limited solely to the arrangements specifically shown or described.

Having described features, discoveries and principles of the exemplary arrangements, the manner in which they are constructed, operated and carried out, and the advantages and useful results that are attained, the new and useful features, devices, elements, arrangements, parts, combinations, systems, equipment, operations, methods, processes and relationships are set forth in the appended claims.

We claim:

1. A method comprising:

a) positioning a pair of grate bars in adjacent side by side relation, wherein each grate bar includes a respective upper side configured to support fuel burned in an incinerator, wherein the respective upper side of each grate bar includes a recess therein, b) subsequent to (a) manipulating a fastener through the respective recesses of the respective grate bars so that the grate bars are held in pressed together relation by the fastener, c) subsequent to (b) covering the recesses with at least one cover, whereby the fastener is rendered inaccessible through the recesses in the upper sides of the grate bars.

2. The method according to claim 1 wherein the respective upper side of each grate bar is bounded by a respective edge, wherein each respective recess extends in the respective upper side inward from the respective edge, wherein in (a) the grate bars are positioned such that the respective recesses are in aligned relation and bound a common opening, wherein in (b) the fastener is manipulated through the common opening, wherein in (c) the common opening which is comprised of the respective recesses is closed by the at least one cover.

3. The method according to claim 1 wherein the respective upper side of each grate bar is bounded by a respective edge, wherein each respective recess extends in the respective upper side inward from the respective edge, wherein in (a) the grate bars are positioned such that the respective recesses are in aligned relation and bound a common opening, and further comprising:

prior to (b) extending the fastener through the common opening such that the fastener is operatively engaged with each grate bar, wherein in (b) the fastener is manipulated through the common opening, wherein in (c) the common opening which is comprised of the respective recesses is closed by the at least one cover.

4. The method according to claim 1 wherein the respective upper side of each grate bar is bounded by a respective edge, wherein each respective recess extends in the respective upper side inward from the respective edge, wherein each grate bar includes a respective projection, wherein each respective projection extends perpendicular to the upper side of the respective grate bar, terminates upwardly below the respective upper side and is accessible through the respective recess, wherein in (a) the grate bars are positioned such that the respective recesses are in aligned relation and bound a common opening, and the respective projections are positioned in side by side relation below the common opening, and further comprising:

prior to (b) extending the fastener through the common opening such that the fastener is operatively engaged with the respective projection of each respective grate bar, wherein in (b) the fastener is manipulated through the common opening, wherein in (c) the common opening which is comprised of the respective recesses is closed by the at least one cover.

5. The method according to claim 1 wherein the respective upper side of each grate bar is bounded by a respective edge, wherein each respective recess extends in the respective upper side inward from the respective edge, wherein each grate bar includes a respective projection, wherein each respective projection is accessible through the respective recess and is disposed away from and extends perpendicular to the upper side of the respective grate bar, wherein the fastener comprises a clamp, wherein in (a) the grate bars are positioned such that the respective recesses are in aligned relation and bound a common opening, and the respective projections are positioned in side by side relation below the common opening, and further comprising:

prior to (b)

extending the clamp through the common opening, and engaging the clamp with each of the respective projections of each of the respective grate bars, wherein in (b) manipulating the clamp is operative to press the grate bars together.

6. The method according to claim 1 wherein the respective upper side of each grate bar is bounded by a respective edge, wherein each respective recess extends in the respective upper side inward from the respective edge, wherein each grate bar includes a respective projection, wherein each respective projection is accessible through the respective recess and is disposed away from and extends perpendicular to the upper side of the respective grate bar, wherein each respective projection includes a respective projection slot, wherein the fastener comprises a threaded fastener, wherein in (a) the grate bars are positioned such that the respective recesses are in aligned relation and provide a common opening, and the respective projections are positioned in side by side relation below the common opening and with the respective projection slots in linearly aligned relation, and further comprising:

prior to (b)

extending the threaded fastener through the common opening, and extending the fastener in each of the respective projection slots of the respective projections of each of the respective grate bars, wherein (b) includes tightening the threaded fastener, wherein tightening the threaded fastener is operative to press the grate bars together.

7. The method according to claim 1 and further comprising:

subsequent to (c) welding the at least one cover to be in fixed engagement with each of the grate bars.

8. The method according to claim 1 and further comprising:

subsequent to (c) fixing the at least one cover in the recesses by pressing at least one wedge operatively between the at least one cover and at least one wall bounding at least one recess.

9. The method according to claim 1 and further comprising:

prior to (c) installing at least one expansion piece in operative connection with the grate bars, wherein the expansion piece has a different coefficient of thermal expansion than each of the grate bars, whereby the grate bars are pressed together with greater force with increased temperature.

10. The method according to claim 1 wherein the respective upper side of each grate bar is bounded by a respective edge, wherein each respective recess extends in the respective upper side inward from the respective edge, wherein in (a) the grate bars are positioned such that the respective recesses are in aligned relation and bound a common opening, wherein the at least one cover comprises a cover, wherein (c) includes engaging a cover projection that is in operative connection with an inner side of the cover, in a cover projection engaging recess in one grate bar, wherein the cover projection engaging recess extends at a first side of the common opening and below the upper side of the one grate bar, engaging a further cover projection that is in operative connection with the inner side of the cover, in a further cover projection engaging recess in the other grate bar, wherein the further cover projection engaging recess extends at a second side of the common opening opposed of the first side and below the upper side of the other grate bar, wherein with the cover projection and the further cover projection engaged with the cover projection engaging recess and further cover projection engaging recess respectively, a cover top on an outer side of the cover extends flush with the upper sides of each of the grate bars.

11. The method according to claim 1 wherein the respective upper side of each grate bar is bounded by a respective edge, wherein each respective recess extends in the respective upper side inward from the respective edge, wherein in (a) the grate bars are positioned such that the respective recesses are in aligned relation and bound a common opening, wherein each grate bar includes a respective projection, wherein each respective projection terminates upwardly below the common opening, is accessible through the common opening and extends perpendicular to the upper side of the respective grate bar, wherein when the grate bars are in pressed together relation, the respective projections are positioned in side by side relation below the common opening, wherein the at least one cover comprises a single cover, wherein (c) includes engaging a cover projection that is in operative connection with an inner side of the cover, in a cover projection engaging recess in one grate bar, wherein the cover projection engaging recess extends at a first side of the common opening and below the upper side of the one grate bar, engaging a further cover projection that is in operative connection with the inner side of the cover, in a further cover projection engaging recess in the other grate bar, wherein the further cover projection engaging recess extends at a second side of the common opening opposed of the first side and below the upper side of the other grate bar, operatively engaging the inner side of the cover with the projections, wherein with the cover projection and further cover projection engaged with the cover projection engaging recess and the further cover projection engaging recess respectively, and with the inner side of the cover operatively engaged with the projections, a cover top on an outer side of the cover extends flush with the upper sides of each of the grate bars.

12. Apparatus comprising:

an arrangement of grate bars configured to support fuel burned in an incinerator, including a first grate bar and a second grate bar, wherein each grate bar includes a respective fuel support side that comprises an upper side of the respective grate bar in an operative position, wherein each respective fuel support side includes a respective recess therein, a fastener, wherein the fastener extends in operative connection with each of the first grate bar and the second grate bar, wherein the fastener in the operative position is disposed below and away from the fuel support sides and is manipulatable through the respective recesses of the first grate bar and the second grate bar to cause the grate bars in the operative position to be pressed together by the fastener, at least one cover, wherein the at least one cover extends in the respective recesses of the first grate bar and the second grate bar and is operative to render the manipulated fastener that holds the grate bars pressed together, inaccessible through the recesses.

13. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars.

14. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars, wherein each grate bar includes a respective projection, wherein each respective projection extends perpendicular to the respective fuel support side of the respective grate bar, and in the operative position terminates upwardly below the common opening, wherein in the operative position the respective projections extend in side by side relation, wherein the fastener is operative to cause the grate bars to be pressed together through operative engagement by the fastener with each of the projections.

15. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars, wherein each grate bar includes a respective projection, wherein each respective projection extends perpendicular to the respective fuel support side of the respective grate bar, and in the operative position terminates upwardly below the common opening, wherein in the operative position the respective projections extend in side by side relation, wherein the fastener comprises at least one clamp, wherein the at least one clamp is operative to cause the grate bars to be pressed together through operative engagement of the at least one clamp with each of the projections.

16. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars, wherein each grate bar includes a respective projection, wherein each respective projection extends perpendicular to the respective fuel support side of the respective grate bar, and in the operative position terminates upwardly below the common opening and includes a respective slot, wherein each slot extends through the respective projection parallel to the respective fuel support side of the respective grate bar, wherein in the operative position the respective projections extend in side by side relation and the respective slots are in aligned linear relation, wherein the fastener comprises a threaded fastener, wherein the threaded fastener extends through both of the respective slots, wherein the threaded fastener is operative to cause the grate bars to be pressed together through operative engagement with each of the projections.

17. The apparatus according to claim 12 and further comprising at least one expansion piece, wherein the at least one expansion piece extends in operative connection with each of the first grate bar and the second grate bar, wherein the at least one expansion piece has a coefficient of thermal expansion different from a coefficient of thermal expansion of each of the grate bars, wherein the expansion piece is operative to cause the grate bars to be pressed together with greater force responsive to increased temperature.

18. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars, wherein the at least one cover is comprised of a cover that is operative to close the common opening and includes a cover top that when the cover is in the opening, is flush with the fuel support sides of each of the first grate bar and the second grate bar.

19. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars, wherein the at least one cover is comprised of a cover that is operative to close the common opening and an insertable wedge that is positioned operatively intermediate of the cover and a recess surface bounding the common opening, wherein the wedge is operative to hold the cover in fixed engagement in the common opening.

20. The apparatus according to claim 12 wherein the fuel support side of each grate bar is bounded by an edge, wherein the respective recesses of each respective grate bar extend in the fuel support side inward from the respective edge of the respective grate bar, and are in aligned relation to bound a common opening that spans between the grate bars, wherein each grate bar includes a respective projection, wherein each respective projection extends perpendicular to the respective fuel support side of the respective grate bar, and in the operative position terminates upwardly below the common opening, wherein the at least one cover is comprised of a cover, wherein the cover includes a cover top that in the operative position extends no higher than the respective fuel support sides of the first grate bar and the second grate bar, a cover inner side that is in operatively engaged relation with both of the respective projections of the first grate bar and the second grate bar, a cover projection and a further cover projection, wherein the cover projection is in operative connection with the inner face and is engaged in a cover projection engaging recess of the first grate bar that in the operative position is disposed below the respective fuel support side of the first grate bar, wherein the further cover projection is in operative connection with the inner face and is engaged in a further cover projection engaging recess of the second grate bar that in the operative position is disposed below the respective fuel support side of the second grate bar.

* * * * *